US007817132B2

(12) United States Patent
Lee et al.

(10) Patent No.: US 7,817,132 B2
(45) Date of Patent: Oct. 19, 2010

(54) COLUMN DRIVER AND FLAT PANEL DISPLAY HAVING THE SAME

(75) Inventors: Seung-Woo Lee, Seoul (KR); Su-Hyun Kwon, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1414 days.

(21) Appl. No.: 11/120,530

(22) Filed: May 2, 2005

(65) Prior Publication Data

US 2005/0248971 A1 Nov. 10, 2005

(30) Foreign Application Priority Data

May 6, 2004 (KR) ..... 10-2004-0031733

(51) Int. Cl.
*G09G 3/36* (2006.01)

(52) U.S. Cl. ..... 345/102; 345/100

(58) Field of Classification Search ..... 345/78, 345/82, 89, 8, 100, 103, 204, 209, 213, 102; 315/323; 365/63
See application file for complete search history.

(56) References Cited

U.S. PATENT DOCUMENTS 6,369,786 B1 * 4/2002 Suzuki ..... 345/77
6,480,180 B1 11/2002 Moon
7,218,305 B2 * 5/2007 Nose ..... 345/102
2001/0015712 A1 8/2001 Hashimoto
2002/0093498 A1 7/2002 Park
2002/0186193 A1 12/2002 Lee
2003/0090451 A1 5/2003 Ann
2003/0132926 A1 7/2003 Lee et al.

FOREIGN PATENT DOCUMENTS

CN 1416110 A 5/2003
CN 14866123 A 1/2004
JP 2003084721 A 3/2003

OTHER PUBLICATIONS

International Search Report for corresponding EP 1594112, 3 pages.

* cited by examiner

*Primary Examiner*—Amare Mengistu
*Assistant Examiner*—Yuk Chow
(74) *Attorney, Agent, or Firm*—Innovation Counsel LLP

(57) ABSTRACT

A flat panel display includes a panel assembly provided with a plurality of gate lines, a plurality of data lines and switching elements connected to the gate lines and the data lines; a signal controller synthesizing digital image data and control signals from an external device and generating synthesized signals and gate control signals; a column driver applying analogue data voltages corresponding to the digital image data to the data lines responsive to the synthesized signals; and a gate driver applying the gate control signals to the gate lines.

19 Claims, 11 Drawing Sheets

COLUMN DRIVER AND FLAT PANEL DISPLAY HAVING THE SAME

BACKGROUND OF THE INVENTION (a) Field of the Invention

The present invention relates to a column driver and a flat panel display having the same.

(b) Description of Related Art

Generally, flat panel displays ("FPDs") convert digital image data such as R, G and B from a host computer into analogue data to display desired gray scale or color image.

FIG. 1 is a block diagram of a conventional flat panel display.

Referring to FIG. 1, the FPD 1000 includes a flat panel assembly 1100, column drivers 1200, gate drivers 1300 and a signal controller 1400.

When the flat panel assembly 1100 has, for example, resolution of XGA grade (1024×768), the flat panel assembly 1100 includes 3,072 (=1024×3) data lines (not shown), 768 gate lines (not shown), a plurality of switching elements (not shown) and a plurality of pixels (not shown). Such structure is generally referred to as an active matrix structure.

The column drivers 1200 convert the digital image data from the signal controller 1400 to analogue data voltages which are transmitted to the pixels via the data lines. In FIG. 1, the column drivers 1200 have called a single bank structure formed on one side of the panel assembly 1100.

The gate drivers 1300 turn on the switching elements in a row simultaneously such that the analogue data voltages driven by the column drivers 1200 are applied to the pixels connected thereto.

The signal controller 1400 receives the digital image data and control signals from a host computer (not shown). In detail, the signal controller 1400 receives the digital image data and the control signals from the host computer in a general digital interface scheme, e.g., a low voltage differential signaling ("LVDS") scheme.

Further, the signal controller 1400 includes an LVDS receiver 1410, a timing generator 1420 and a reduced swing differential signaling ("RSDS") transmitter 1430.

The LVDS receiver 1410 receives the digital image data and the control signals from an external device. The timing generator 1420 converts the control signals into a plurality of control signals suitable for the column drivers 1200 and the gate drivers 1300. The RSDS transmitter 1430 converts the digital image data and the control signals of the LVDS scheme into those of the RSDS scheme for transmittance to the column drivers 1200.

FIG. 2 is a conventional operation timing chart and FIG. 3 is a drawing to illustrate the formats of digital image data of an RSDS scheme.

Referring to FIGS. 2 and 3, if the digital image data is signals of 6 bits, respectively, the signal controller 1400 transmit the digital image data and the control signals via three pairs of signal lines (not shown) for each of RGB and a pair of clock lines (not shown). In detail, the signal controller 1400 transmits them to the column drivers 1200 via nine pairs (=three pairs×RGB) of the signal lines and a pair of the clock lines.

FIG. 4 is a detail block diagram of a column driver of an RSDS scheme.

Referring to FIG. 4, the column drivers 1200 includes an RSDS receiver 1210, a shift register 1220, a data register 1230, a data latch 1240, a D/A converter 1250 and an output buffer 1260.

The RSDS receiver 1210 receives the digital image data of the RSDS scheme from the signal controller 1400. The shift register 1220 gets the digital image data to be loaded from the data register 1230 to the data latch 1240 at a time. The signal controller 1400 transmits the digital image data to the column driver 1200 until all the latches of the data latch 1240 are filled with the data. The signal controller 1400 also transmits the digital image data to the column driver 1200 until all the row data are loaded. Subsequently, the column driver 1200 loads the digital image data loaded to the data latch 1240 to the D/A converter 1250. The D/A converter 1250 converts the digital image data into the analogue data voltages. Thereafter, the output buffer 1260 applies the analogue data voltages to the respective data lines of the panel assembly 1100.

Typically, the FPD transmits the digital image data and the control signals via a plurality of signal lines and clock lines. Such form of transmission has problems that power consumption and electromagnetic interference ("EMI") increase.

SUMMARY OF THE INVENTION

An object of the present invention is to provide a flat panel display capable of decreasing power consumption and EMI.

A flat panel display is provided, which includes a panel assembly provided with a plurality of gate lines, a plurality of data lines and switching elements connected to the gate lines and the data lines; a signal controller synthesizing digital image data and control signals from an external device and generating synthesized signals and gate control signals; a column driver applying analogue data voltages corresponding to the digital image data to the data lines responsive to the synthesized signals; and a gate driver applying the gate control signals to the gate lines.

The synthesized signals may be generated responsive to a data output control signal.

The synthesized signals may include a polarity control signal POL, a load signal LOAD and a horizontal synchronization start signal STH.

The polarity control signal and the load signal may be transmitted via different data buses of the plurality of data buses. The polarity control signal and the load signal are preferably generated during a data blank interval.

The polarity control signal may be generated based on a logic combination of the data output control signal and the digital image data. For example, the polarity control signal and the load signal may be generated when the data output control signal is in the logic state of low.

The signal controller may operate in a current driving scheme.

The signal controller outputs the synthesized signals to the column drivers that are arranged in symmetry with respect to central point of the panel assembly.

Herein, the column driver may include a plurality of column driving elements and the column driving elements may be connected to each other by cascade connection.

A flat panel display is provided, which includes a panel assembly provided with a plurality of gate lines, a plurality of data lines and switching elements connected to the gate lines and the data lines; a signal controller synthesizing digital image data and a first control signal from an external device and generating a synthesized signal, a second control signal and a gate signal; a column driver applying analogue data voltages corresponding to the digital image data to the data lines responsive to the synthesized signal and the second control signal; and a gate driver applying the gate signal to the gate lines.

The second control signal may include a horizontal synchronization start signal STH and a load signal LOAD depending on a logic combination of a data enable signal DE.

The horizontal synchronization start signal may be generated when the data enable signal is in the logic state of high and the second control signal is in the logic state of low and the load signal may be generated when the data enable signal is in the logic state of low and the second control signal is in the logic state of low.

A column driver is provided, which includes a digital signal generator generating a horizontal synchronization start signal STH and a load signal LOAD responsive to a control signal from an external device; a shift register receiving the horizontal synchronization start signal; a data latch receiving the load signal; a D/A converter receiving a polarity control signal; and an output buffer.

The digital signal generator may operate responsive to a logic combination of the control signal and a data enable signal DE.

The horizontal synchronization start signal may be generated when the data enable signal is in the logic state of high and the control signal is in the logic state of low and the load signal may be generated when the data enable signal is in the logic state of low and the control signal is in the logic state of low.

BRIEF DESCRIPTION OF THE DRAWINGS

The present invention will become more apparent by describing preferred embodiments thereof in detail with reference to the accompanying drawings in which.

DETAILED DESCRIPTION OF EMBODIMENTS

Figure 1:
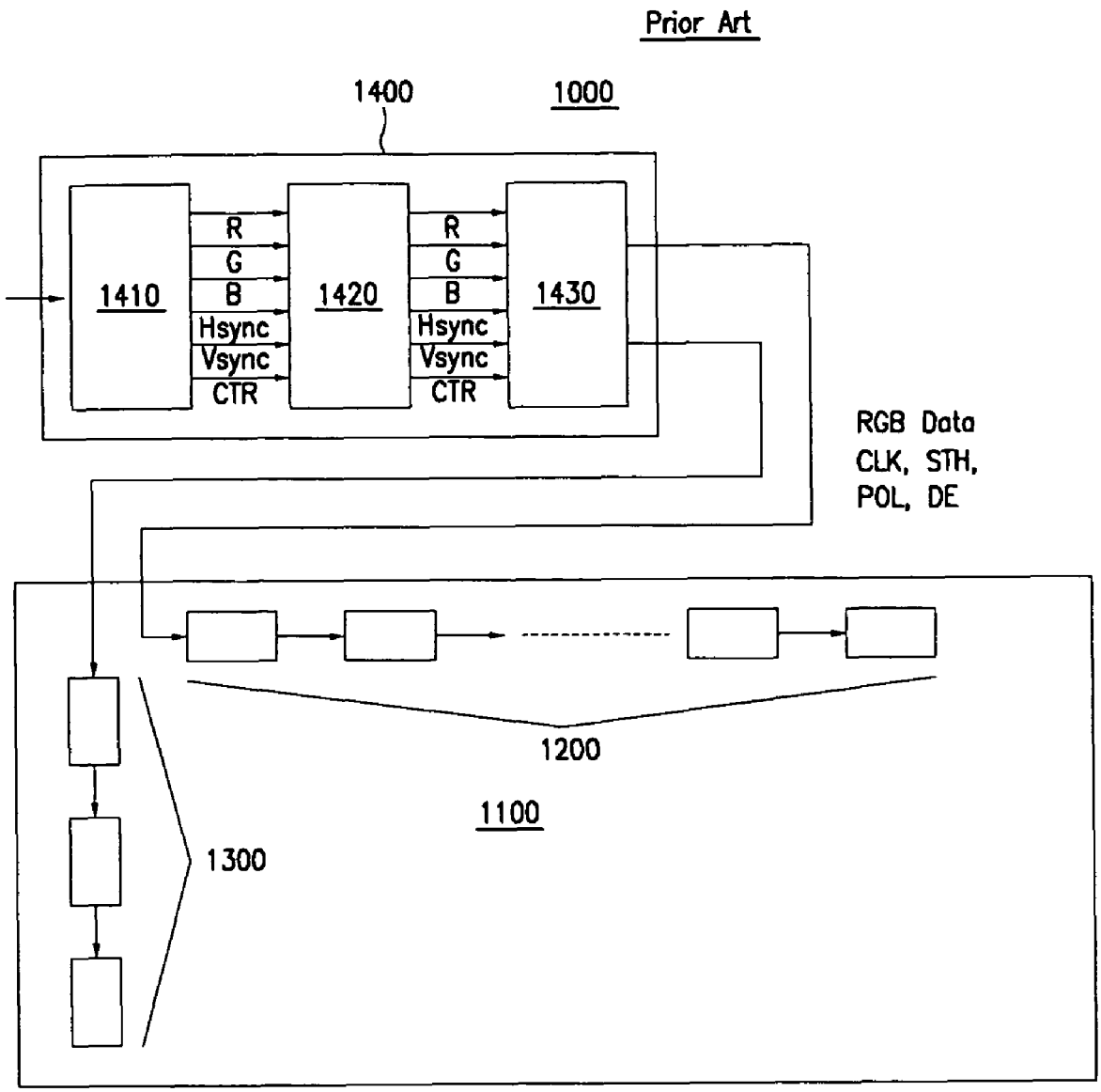
FIG. 1 is a block diagram of a conventional FPD.
Figure 2:
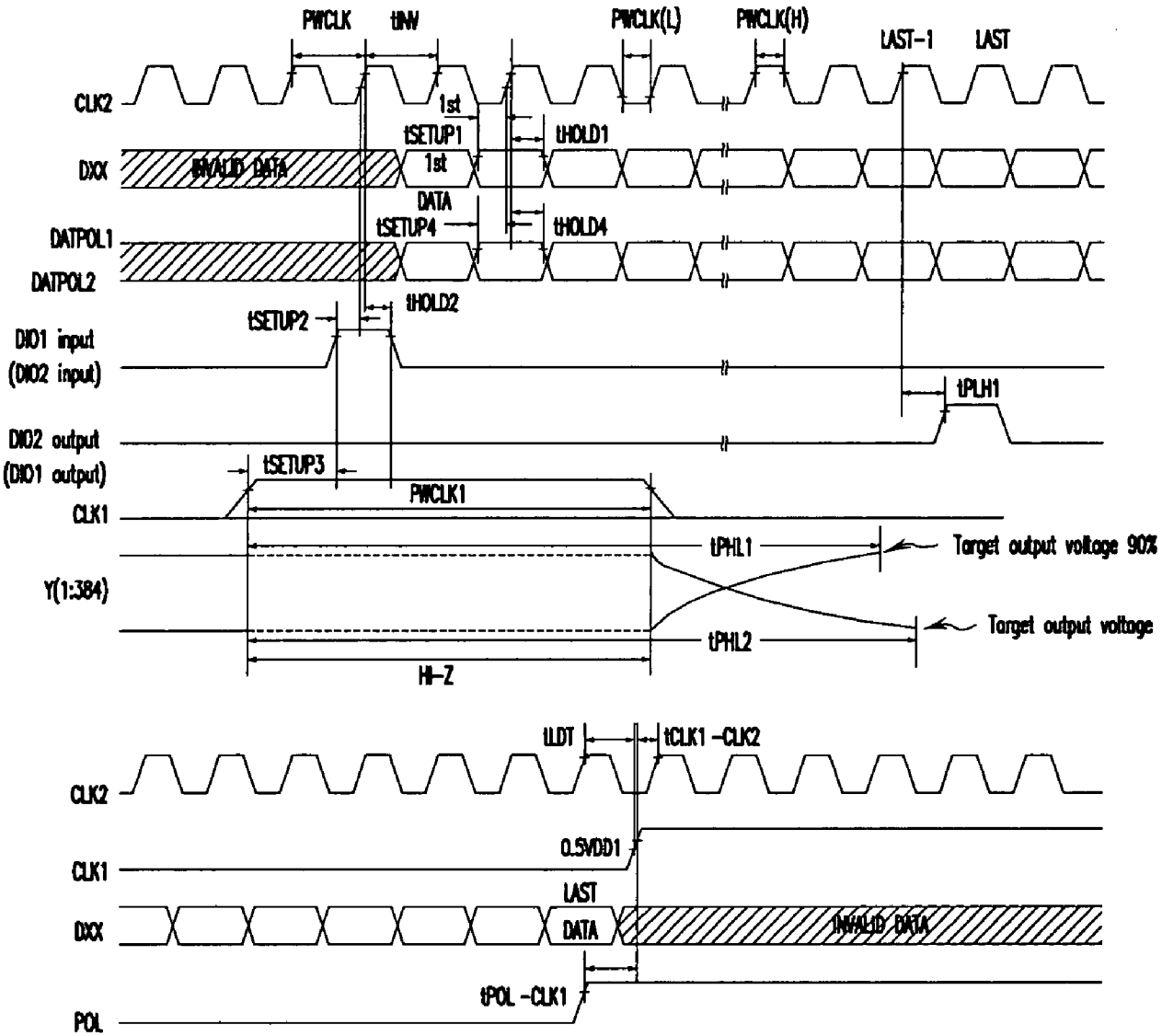
FIG.2 Prior Art
FIG. 2 is an operation timing chart of a conventional FPD.
Figure 3:
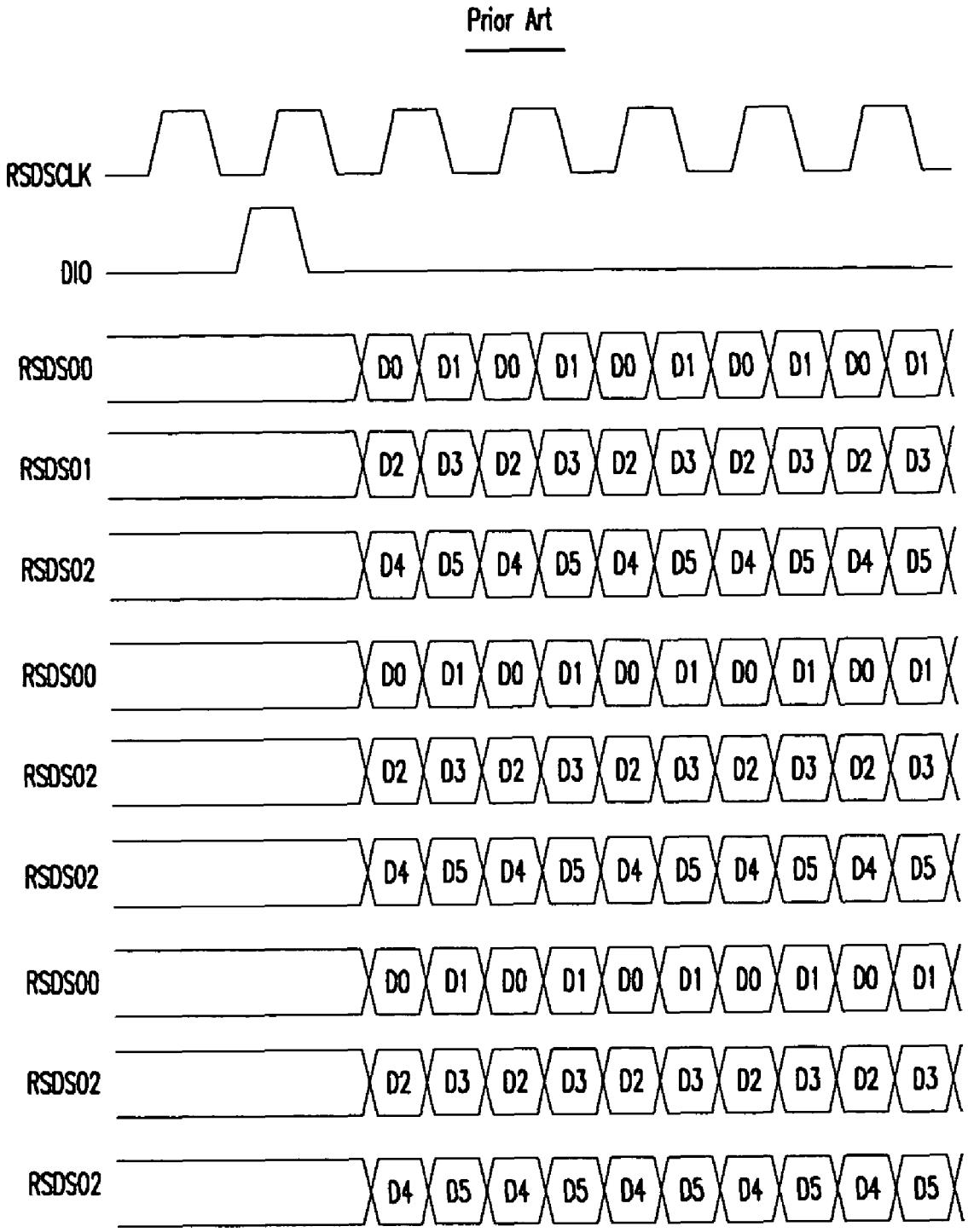
FIG. 3 is a drawing to illustrate the formats of digital image data of an RSDS scheme.
Figure 4:
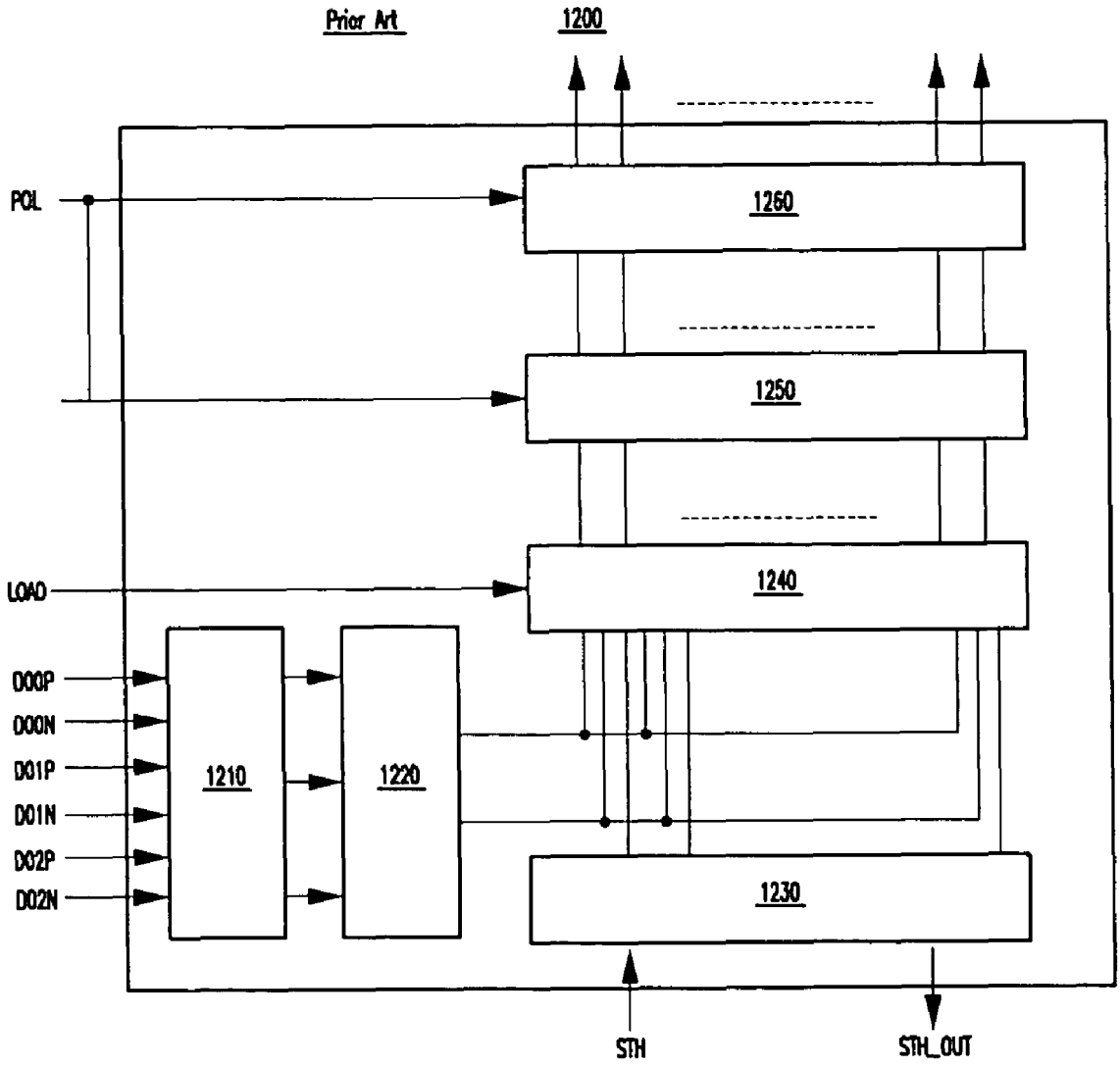
FIG. 4 is a detail block diagram of a conventional column driver of an RSDS scheme.

The present invention will now be described more fully hereinafter with reference to the accompanying drawings, in which preferred embodiments of the inventions invention are shown. This invention may, however, be embodied in many different forms and should not be construed as limited to the embodiments set forth herein.

In the drawings, the thickness of layers and regions are exaggerated for clarity. Like numerals refer to like elements throughout. It will be understood that when an element such as a layer, film, region, substrate or panel is referred to as being "on" another element, it can be directly on the other element or intervening elements may also be present. In contrast, when an element is referred to as being "directly on" another element, there are no intervening elements present.

Then, a column driver and a FPD having the same according to embodiments of the present invention will be described with reference to the drawings.

Figure 5:
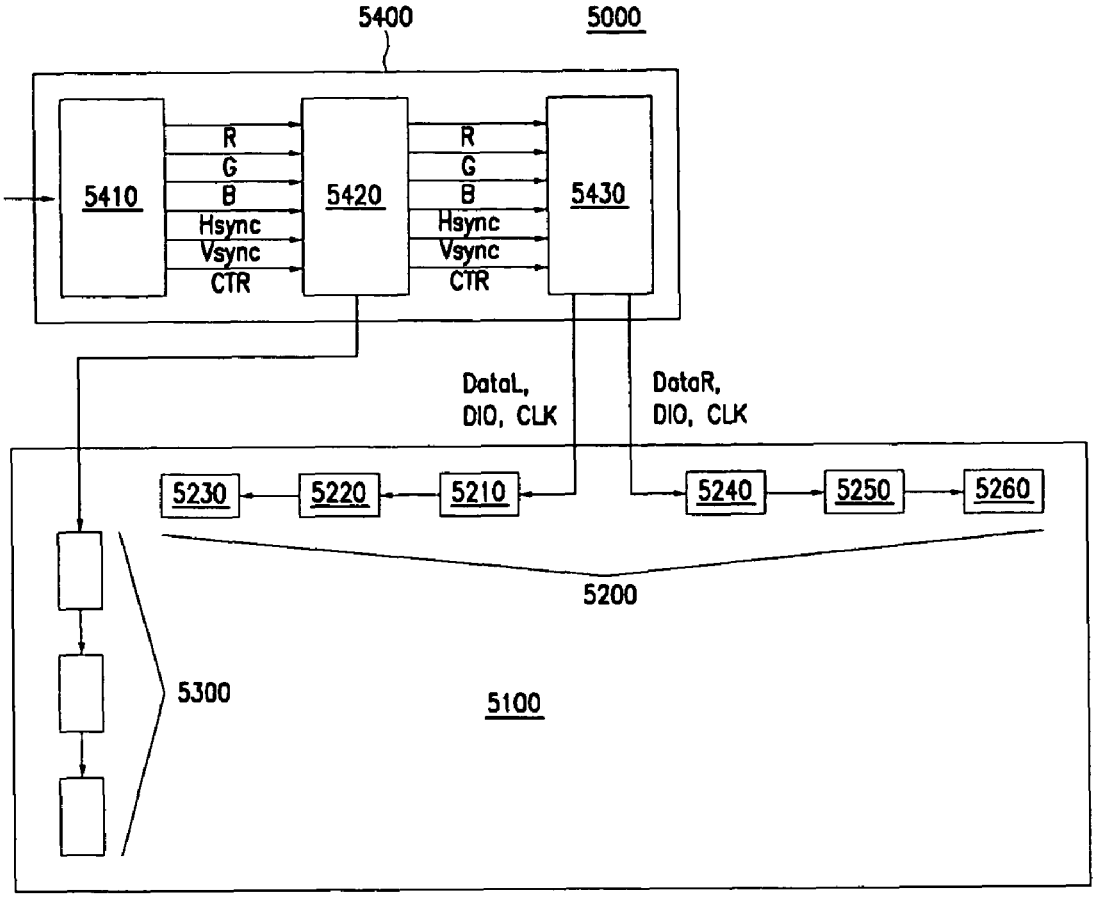
FIG. 5 is a block diagram of an FPD according to the first embodiment of the present invention.

FIG. 5 is a block diagram of an FPD according to the first embodiment of the present invention.

Referring to FIG. 5, the FPD 5000 according to the first embodiment of the present invention includes a panel assembly 5100, column drivers 5200, gate drivers 5300 and a signal controller 5400.

The FPD 5000 may be a thin film transistor liquid crystal display (TFT-LCD) of an active matrix structure. However, the FPD 5000 is not limited to the TFT-LCD of an active matrix structure.

The signal controller 5400 includes an LVDS receiver 5410, a timing generator 5420 and a current driver 5430.

The LVDS receiver 5410 transmits digital image data such as R, G and B of an LVDS scheme and control signals such as Hsync, Vsync and CTR from a host computer (not shown) to the timing generator 5420. The timing generator 5420 generates control signals required for the column drivers 5200 and the gate drivers 5300. The current driver 5430 synthesizes the digital image data R, G and B of the LVDS scheme and the control signals in a current driving scheme for transmittance to the column drivers 5200.

The column drivers 5200 are comprised of a plurality of column driving elements 5210 to 5260 which are connected to each other by cascade connection. The column driving elements 5210 to 5260 are preferably arranged in symmetry with respect to the input from the signal controller 5400. However, the FPD is not limited to the symmetrical structure and may be embodied in many different forms. Further, the FPD may employ digital interface of a voltage driving scheme or a current driving scheme.

The gate drivers 5300 are comprised of a plurality of gate driving elements directly mounted on the panel assembly 5100, which operate in a way that the adjacent gate driving element receives many kinds of control signals from the signal controller 5400 for transmittance to the subsequent gate driving element. Further, the gate drivers 5300 apply control signals for control of the switching elements to the gate lines. Such structure is typical a chip on glass ("COG") type, the gate drivers 5300 may be, however, integrated together with the switching elements.

Figure 6:
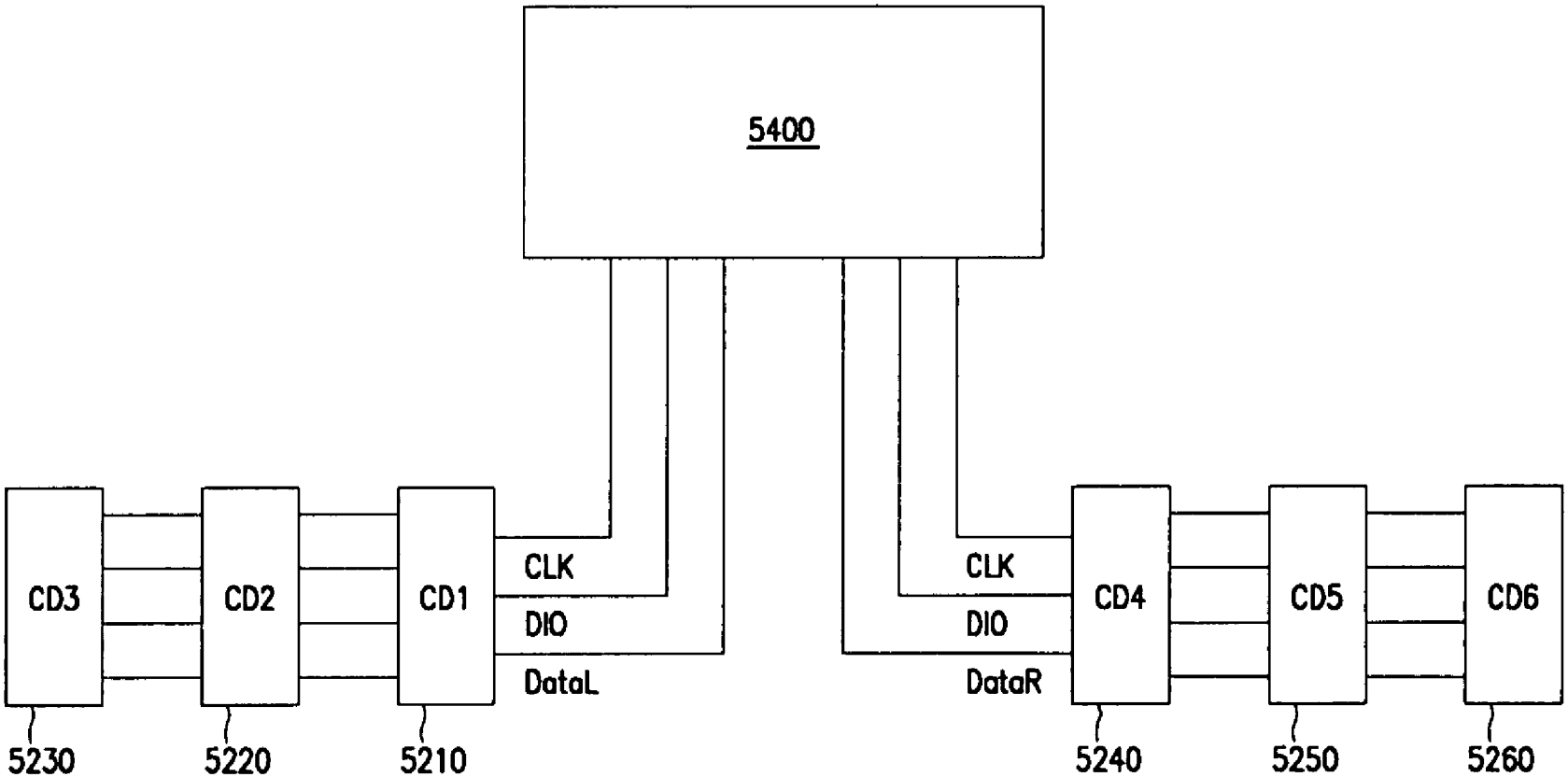
FIG. 6 illustrates the relation of the connection of the signals controller and the column driver shown in FIG. 5.

FIG. 6 illustrates relation of connection of the signals controller 5400 and the column driving elements 5210 to 5260 shown in FIG. 5.

Referring to FIGS. 5 and 6, a group of column driving elements 5210 to 5230 are connected to the signal controller 5400 sequentially and other group of column driving elements 5240 to 5260 are connected to the signal controller 5400 sequentially.

The column driving element 5240 is supplied with a clock signal CLKR, a first control signal DIOR and data DataR from the signal controller 5400 and the column driving element 5210 is supplied with a clock signal CLKL, a first control signal DIOL and data DataL. The first control signal DIO is sometimes referred to as the data output control signal. In the preset embodiment, clock signals CLKR AND CLKL are the same clock signal derived from the clock signal CLK and are therefore denoted as clock signal CLK in FIG. 5. Similarly, the first control signal DIOR and DIOL are the same control signal and are therefore denoted as first control signal DIO in FIG. 5.

The column driving elements 5240 and 5210 receive all the data related thereto and then transmit control signals and data corresponding to the subsequent column driving elements 5220 and 5250 from the signal controller 5400 thereto. The column driving elements 5220 and 5250 repeat such operations.

Each column driving element 5210 to 5260 recognizes a HORIZONTAL SYNCHRONIZATION START SIGNAL and a load signal in response to the combination of a logic state of the first control signal and the data signals.

The signal controller 5400 outputs a polarity control signal POL to other data bus during a predetermined interval. That is, the polarity control signal POL is transmitted to each column driving element 5210 to 5260 during an interval with no digital image data.

Accordingly, the FPD 5000 according to the first embodiment of the present invention does not require signal lines for transmitting the polarity control signal POL and the load signal LOAD, and according thereto it is possible to reduce the number of the signal lines and current consumption and EMI, sequentially.

Figure 7:
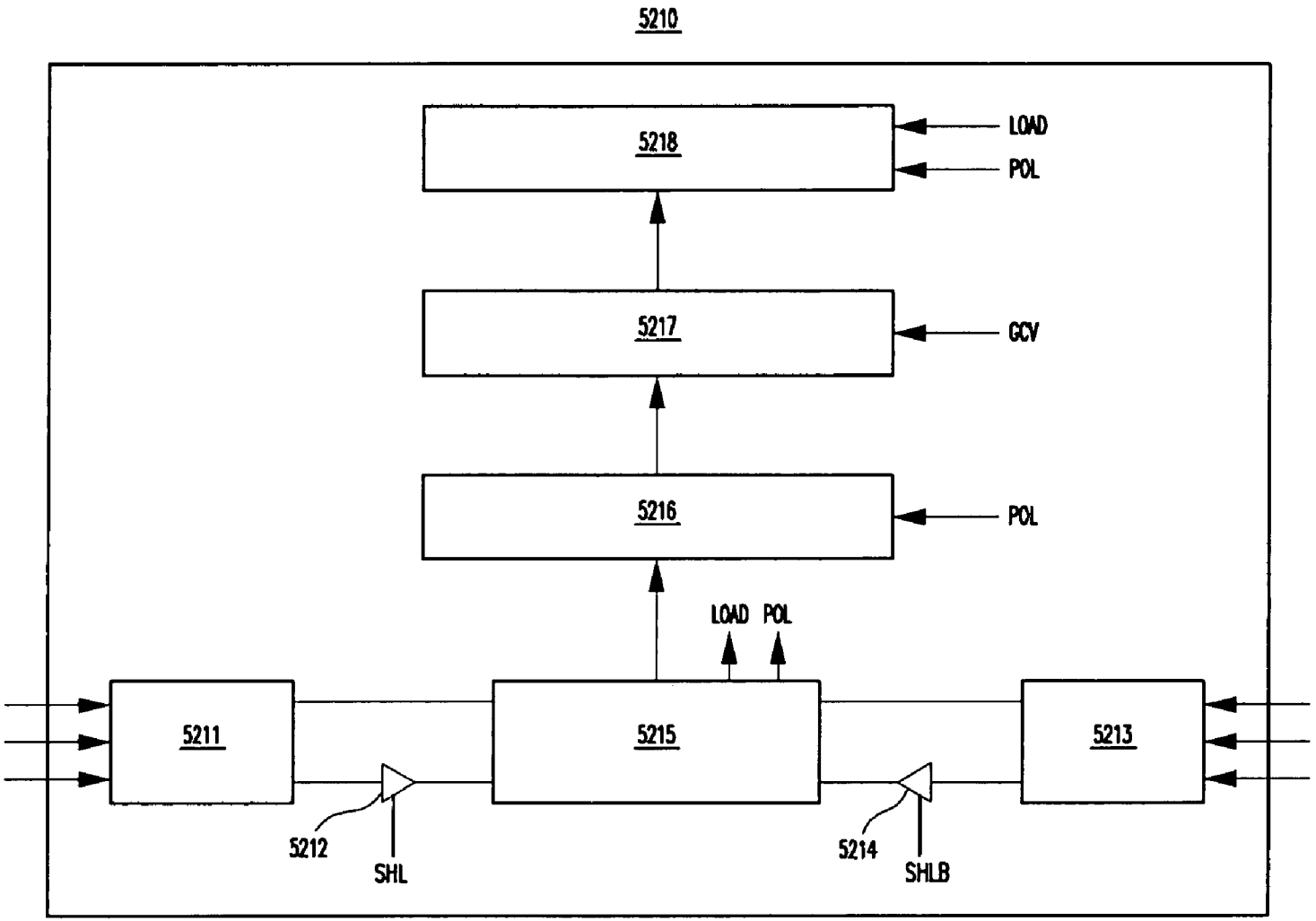
FIG. 7 is a detail circuit diagram of the column driver shown in FIG. 5.

FIG. 7 is a detail block diagram of the column driving element shown in FIG. 5.

Referring to FIGS. 5 to 7, each column driving element 5210 to 5260 is bidirectional. The column driving element 5210 transmits the control signals and the data to the column driving circuit 5220 which transmits them to the column driving circuit 5230, sequentially. Further, the column driving elements 5240 to 5260 transmit the control signals and the data in the same manner.

A detail block diagram of column driving element 5210 will be described in detail with reference to FIG. 7. The other column driving elements can have the same structure as the column driving element shown in FIG. 7.

The column driving element 5210 includes a first transceiver 5211, a first input buffer 5212, a second transceiver 5213, a second input buffer 5214, a logic circuit 5215, a data latch and selector 5216, a D/A converter 5217 and an output buffer 5218.

Directions of transmitting signals of the first and the second input buffers 5212 and 5214 and the logic circuit 5215 are determined on the basis of logic states of control signals SHL and SHLB outputted from the signal controller 5400.

Figure 8:
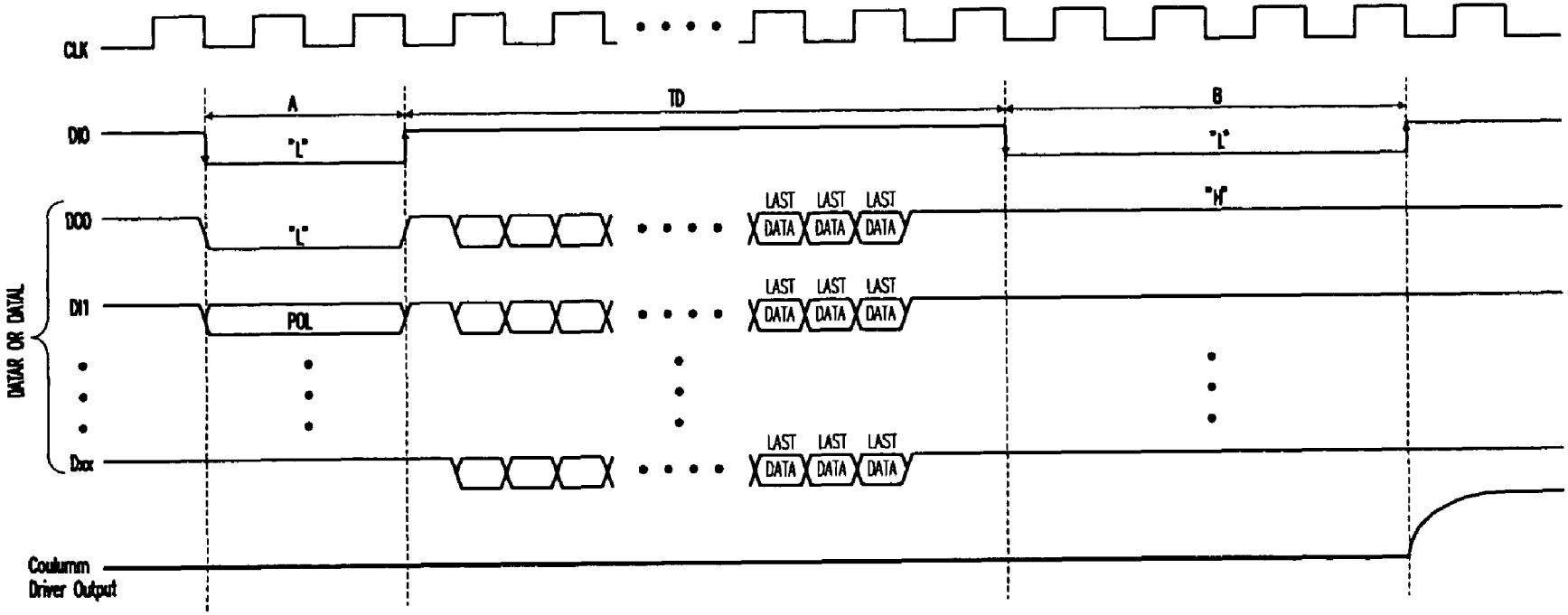
FIG. 8 is an operation timing chart of the FPD shown in FIG. 5.

FIG. 8 is an operation timing chart of the FPD shown in FIG. 5.

An operation of each column driving element 5120 to 5260 will be described with reference to FIGS. 5 to 8.

In interval A, the signal controller 5400 generates a clock signal CLK, a first control signal DIO, a second control signal and a polarity control signal POL.

During the interval A, the signal controller 5400 transmits the clock signal CLK, the first control signal DIO in the logic state of low and the second control signal in the logic state of low to the first column driving element 5210 via a first data line D00 of the plurality of data lines D00 to Dxx. Further, the signal controller 5400 transmits the polarity control signal POL to the first column driving element 5210 via the second data line D01.

The first input buffer 5212 enabled responsive to the control signal SHL transmits many signals such as CLK, DIO and DATAL from the first transceiver 5211 to the logic circuit 5215. In this case, the second input buffer 5214 is disabled responsive to a control signal SHLB. The control signals SHL and SHLB are preferably complementary.

In the interval A, the logic circuit 5215 recognizes a combination of the first control signal DIO and the second control signal in the logic state of low as a data start signal Load. The logic circuit 5215 receives and latches the polarity control signal POL. The polarity control signal POL is used as a signal for determining output polarity of the latched display data.

During transmitting interval TD of the digital image data, the signal controller 5400 transmits the first control signal DIO in the logic state of high and the digital image data DATAL to the column driving element 5210 via the data lines D00 to Dxx.

The logic circuit 5215 transmits the digital image data DATAL to the data latch and selector 5216 which receives and latches the digital image data DATAL allocated to the column driving element 5210 synchronized with falling and rising edges of the clock signal CLK. The D/A converter 5217 converts the digital image data DATAL into analogue voltages according to corresponding gray voltages.

Before the entire digital image data DATAL allocated to the column driving element 5210 are latched to the data latch and selector 5216, the column driving element 5210 generates and transmits the first control signal DIO in the logic state of low to the adjacent column driving element 5220 via the first data line D00 and transmits the latched polarity control signal POL thereto via the second data line D01, during the transmitting interval TD of the digital image data.

Accordingly, the column driving element 5220 receives the first control signal DIO in the logic state of low and the second control signal in the logic state of low and thereafter is ready to receive the digital image data DATAL allocated thereto. The column driving element 5220 latches the digital image data DATAL allocated thereto synchronized with the rising and falling edges of the clock signal CLK.

That is, the clock signal CLK is transmitted to the column driving element 5210, and the column driving element 5210 generates and transmits the first control signal DIO to the column driving element 5220. Moreover, the column driving element 5210 generates and transmits the second control signal to the column driving element 5220 via the first data line D00, and generates and transmits the polarity control signal POL to the column driving element 5220 via the second data line D01. Accordingly, the column driving element 5220 receives and latches the digital image data DATAL allocated thereto during the transmitting interval TD of the digital image data.

The column driving elements 5210 to 5260 receives and stores the digital image data allocated thereto by the above-described operation during the transmitting interval TD of the digital image data.

The column driving elements 5210 to 5260 according to the embodiment of the present invention store the digital image data synchronized with both the rising and the falling edges of the clock signal CLK.

When all of the digital image data allocated to the respective column driving elements 5210 to 5260 are stored thereto, the signal controller 5400 transmits the first control signal DIO in the logic state of low and the second control signal in the logic state of high via any one of the data lines D00 to Dxx to each column driving element 5210 to 5260.

The logic circuit 5215 of the each column driving element 5210 to 5260 generates a load signal LOAD based on the first control signal DIO in the logic state of low and the second control signal in the logic state of high.

Therefore, each column driving element 5210 to 5260 drives the data lines on the panel assembly 5100 based on the digital image data in response to the polarity control signal POL and the load signal LOAD such that the digital image data are displayed on the panel assembly 5100. The polarity control signal POL are latched in the logic circuit 5215 until new polarity control signal is inputted thereto.

As described above, each column driving element 5210 to 5260 drives the data lines on the panel assembly 5100 in response to the polarity control signal POL and the load signal LOAD such that the digital image data are displayed on the panel assembly 5100. The signal controller 5400 and the respective column driving elements 5210 to 5260 share transmission regulation of signals including the first and the second control signals and the polarity control signal POL and information about buses (or data lines) for transmitting the signals.

Figure 9:
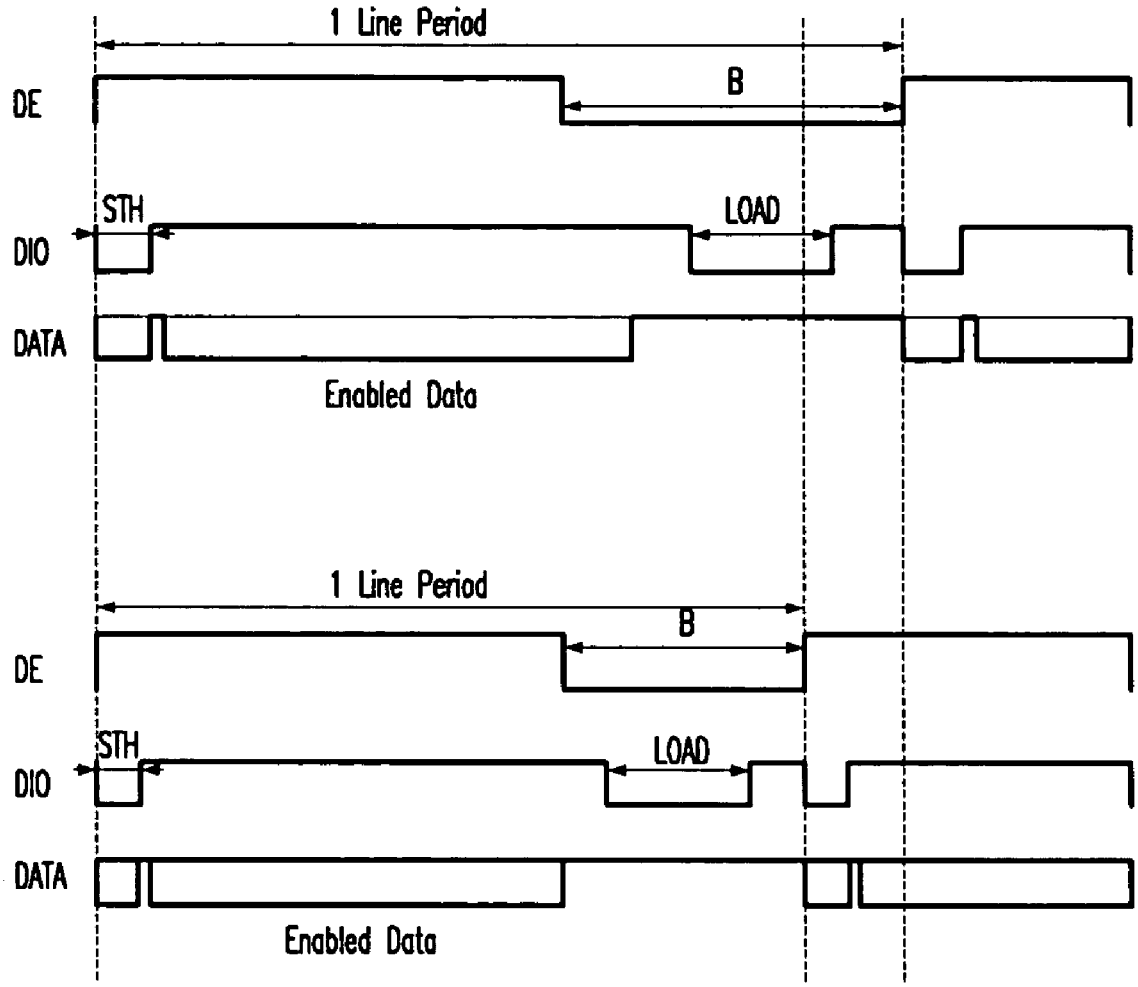
FIG. 9 is an operation timing chart of an FPD according to the second embodiment of the present invention.

FIG. 9 is an operation timing chart of an FPD according to a second embodiment of the present invention.

Referring to FIG. 9, the signal controller 5400 outputs many kinds of control signals with high frequencies in order to reduce the time that it takes to drive a horizontal line. In detail, during interval B, the signal controller 5400 outputs control signals having driving intervals such as at least an interval of the horizontal synchronization start signal STH (2 clocks), an interval of the first data (0.5 clock), an interval of the last data and the load signal (16 clocks), an interval of the load signal (28 clocks) and an interval of the load signal and the horizontal synchronization start signal STH (4 clocks). As described above, the driving time of a horizontal line requires a total of 50.5 clocks.

Therefore, the signal controller 5400 outputs the control signals with higher than existing frequencies using its own phase locked loop ("PLL") circuit, thereby assuring enough driving margin in displaying data of a horizontal line.

Figure 10:
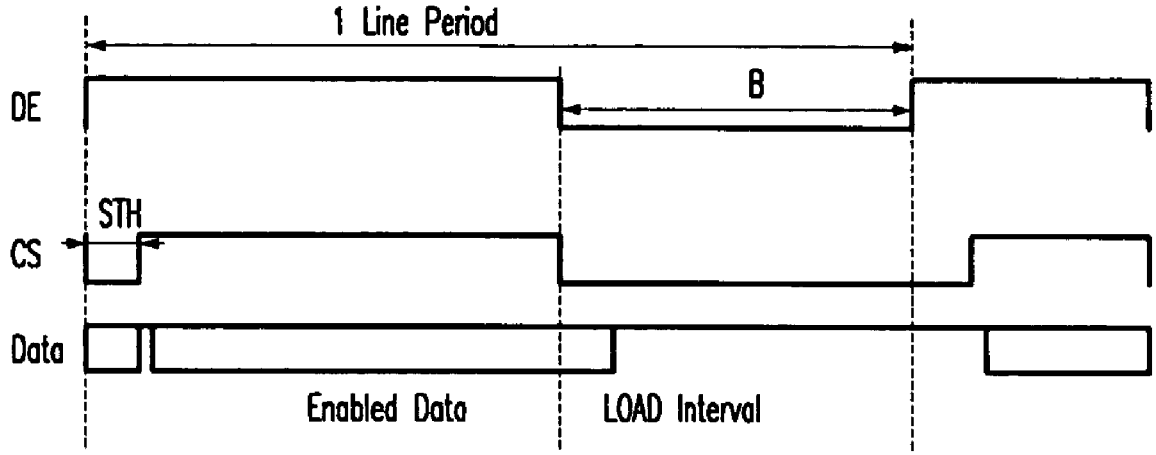
FIG. 10 is an operation timing chart of an FPD according to the third embodiment of the present invention.

FIG. 10 is an operation timing chart of an FPD according to the third embodiment of the present invention.

Referring to FIG. 10, the signal controller 5400 generates another control signal such as CS. In detail, the signal controller 5400 recognizes the horizontal synchronization start signal STH when the control signal CS is in the logic state of low and outputs data based on an internal specification. After outputting the last data, the signal controller 5400 outputs an interval of the load (the LOAD interval) to the data lines at the moment when the control signal CS is in the logic state of high. The column driving elements 5210 to 5260 recognize the control signal CS and the interval of the load (the LOAD interval) and operate based thereon. Accordingly, the FPD 5000 assures enough driving margin in displaying THE data of a line.

Figure 11:
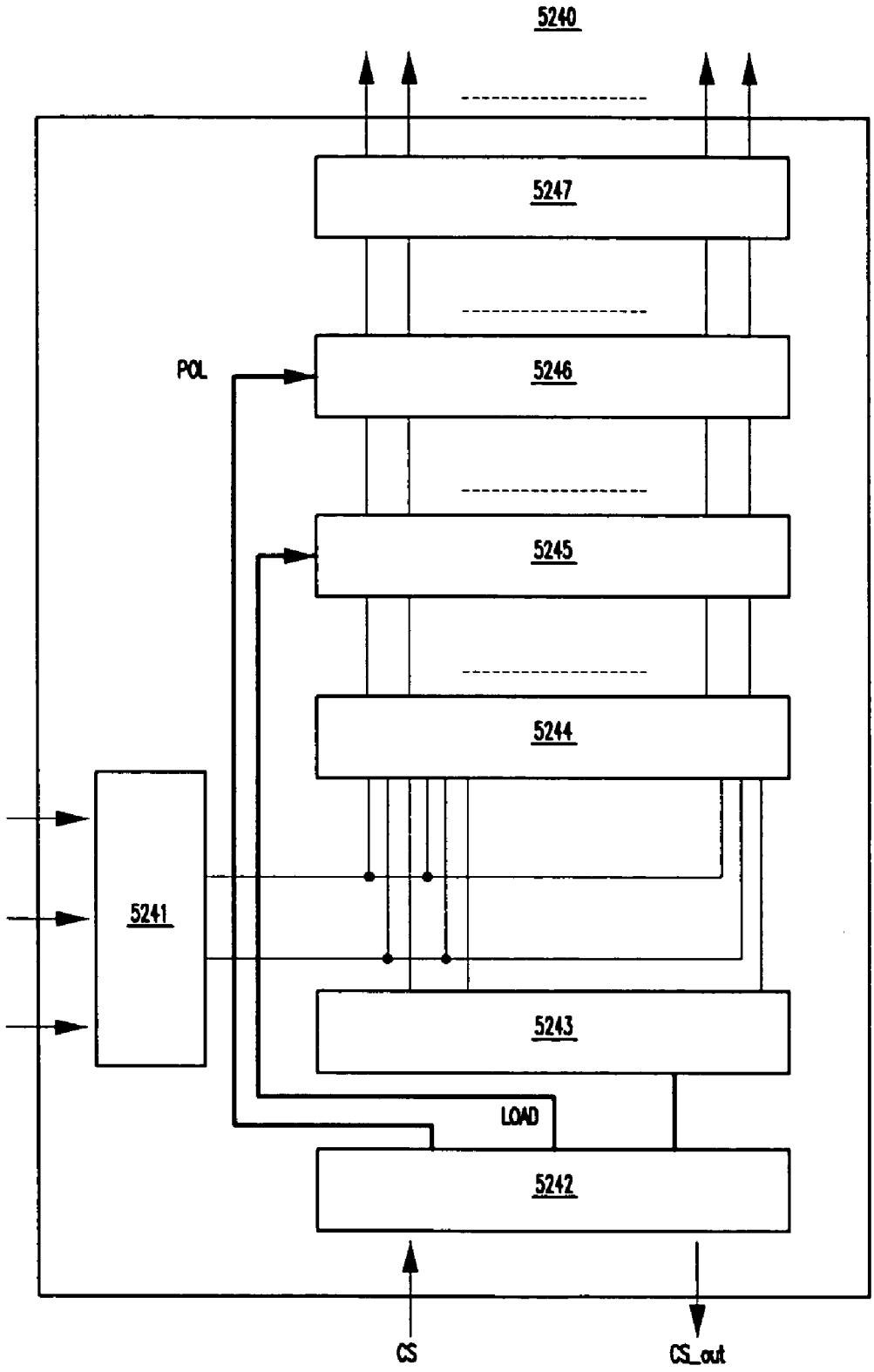
FIG. 11 is a detail block diagram of the column driver shown in FIG. 5

FIG. 11 is a detail block diagram of column driving element 5240 according to an alternate embodiment of the present invention. The other column driving elements 5210 to 5230, 5250 and 5260 can have the same configurations as that shown in FIG. 11.

Referring to FIG. 11, the column driving element 5240 includes a data controller 5241, a digital signal generator 5242, a shift register 5243, a data register 5244, a data latch 5245, a D/A converter 5246 and an output buffer 5247. The column driving element 5240 substantially has the same configuration as a typical column driving element, and further includes the digital signal generator 5242 relative thereto.

The digital signal generator 5242 transmits a horizontal synchronization start signal STH to the shift register 5243 responsive to the control signal CS generated from the signal controller 5400 and also transmits the load signal LOAD to the data latch 5245 and the polarity control signal POL to the D/A converter 5246. According thereto, the signal controller 5400 drives the column driving element 5240 without generating the horizontal synchronization start signal STH, the polarity control signal POL and the load signal LOAD. As a result, since a plurality of signal lines for transmitting the signals STH, POL and LOAD are not required and the number of the signals decreases, power consumption and EMI decrease.

As described above, the FPD according to embodiments of the present invention reduces the number of the buses connected between the signal controller and the column driving elements. Accordingly, the currents that the FPD consumes are reduced as much as the number of buses is reduced. Further, the EMI that the FPD generates is decreased as well.

It is possible to design the thickness and/or the intervals of the lines efficiently according to the reduced number of buses. According thereto, in case of an FPD using a current driving scheme, it is possible to improve performance thereof due to reduction of resistance of the lines.

Furthermore, it is possible to assure enough driving margin by driving the FPD responsive to a separate control signal with higher frequency.

While the present invention has been described in detail with reference to the preferred embodiments, it is to be understood that the invention is not limited to the disclosed embodiments, but, on the contrary, is intended to cover various modifications and equivalent arrangements included within the sprit and scope of the appended claims.

What is claimed is:

1. A flat panel display comprising:

a panel assembly provided with a plurality of gate lines, a plurality of data lines and switching elements connected to the gate lines and the data lines;

a signal controller synthesizing digital image data and a first control signal from an external device and generating synthesized signals, at least one of the synthesized signals having a part of the digital image data and a second control signal in a period; and a column driver applying analogue data voltages corresponding to the digital image data to the data lines response to the second control signal, wherein the column driver recognizes a horizontal synchronization start signal STH and a load signal LOAD in response to the combination of a logic state of the first control signal and the digital image data.

2. The flat panel display of claim 1, wherein the signal controller further generates a third control signal, the synthesized signals are generated response to the third control signal.

3. The flat panel display of claim 2, wherein the second control signal comprise at least one of a polarity control signal POL, the load signal LOAD and the horizontal synchronization start signal STH.

4. The flat panel display of claim 3, wherein the polarity control signal and the load signal are transmitted via different data buses of a plurality of data buses between the signal controller and the column driver.

5. The flat panel display of claim 4, wherein the polarity control signal and the load signal are generated during a data blank interval.

6. The flat panel display of claim 5, wherein the column driver recognizes the at least one of the load signal LOAD, horizontal synchronization start signal STH, and the polarity control signal based on the third control signal and the at least one of the synthesized signals.

7. The flat panel display of claim 6, wherein the polarity control signal and the load signal are recognized when the third control signal is in the logic state of low.

8. The flat panel display of claim 4, wherein the first synthesized signal of the at least one of the synthesized signals is transmitted via a first data bus of the plurality of data buses, the first synthesized signal has the part of the digital image data and the second control signal comprising the load signal LOAD and the horizontal synchronization start signal STH.

9. The flat panel display of claim 8, wherein the horizontal synchronization start signal STH, the part of the digital image data and the load signal LOAD are sequentially transmitted to the column driver in the period.

10. The flat panel display of claim 1, wherein the signal controller operates in a current driving scheme.

11. The flat panel display of claim 10, wherein the signal controller outputs the synthesized signals to the column drivers that are arranged in symmetry with respect to central point of the panel assembly.

12. The flat panel display of claim 1, wherein the column driver comprises a plurality of column driving elements and the column driving elements are connected to each other by cascade connection.

13. A flat panel display comprising:

a panel assembly provided with a plurality of gate lines, a plurality of data lines and switching elements connected to the gate lines and the data lines;

a signal controller synthesizing digital image data and a first control signal from an external device and generating a synthesized signal and a fourth control signal, the fourth control signal having a plurality of fifth control signals depending on a sixth control signal; and a column driver applying analogue data voltages corresponding to the digital image data to the data lines in response to the synthesized signal and the plurality of the fifth control signals, wherein the column driver recognizes a horizontal synchronization start signal STH and a load signal LOAD in response to the combination of a logic state of the first control signal and the digital image data.

14. The flat panel display of claim 13, wherein the plurality of fifth control signals are the horizontal synchronization start signal STH and the load signal.

15. The flat panel display of claim 14, wherein the horizontal synchronization start signal is recognized when the sixth control signal is in the logic state of high and the fourth control signal is in the logic state of low.

16. The flat panel display of claim 14, wherein the load signal is recognized when the sixth control signal is in the logic state of low and the fourth control signal is in the logic state of low.

17. A column driver comprising:

a digital signal generator generating a horizontal synchronization start signal STH and a load signal LOAD responsive to a control signal from an outside of the column driver and a data enable signal DE;

a shift register receiving the horizontal synchronization start signal;

a data latch receiving the load signal;

a D/A converter receiving a polarity control signal; and an output buffer, wherein the column driver generates the horizontal synchronization start signal STH and the load signal LOAD in response to the combination of a logic state of the control signal and image data.

18. The column driver of claim 17, wherein the horizontal synchronization start signal is generated when the data enable signal is in the logic state of high and the control signal is in the logic state of low.

19. The column driver of claim 17, wherein the load signal is generated when the data enable signal is in the logic state of low and the control signal is in the logic state of low.

* * * * *